US010720144B2

(12) United States Patent
Darlington et al.

(10) Patent No.: US 10,720,144 B2
(45) Date of Patent: Jul. 21, 2020

(54) EARPHONE TEST SYSTEM

(71) Applicants: Paul Darlington, Canton Vaud (CH); Ben Skelton, Canton Vaud (CH); Mark Donaldson, Canton Vaud (CH)

(72) Inventors: Paul Darlington, Aran-Villette (CH); Ben Skelton, Aran-Villette (CH); Mark Donaldson, Aran-Villette (CH)

(73) Assignee: SOUNDCHIP SA, Aran-Villette (CH)

( * ) Notice: Subject to any disclaimer, the term of this patent is extended or adjusted under 35 U.S.C. 154(b) by 0 days.

(21) Appl. No.: 16/084,444

(22) PCT Filed: Mar. 10, 2017

(86) PCT No.: PCT/GB2017/050645
§ 371 (c)(1),
(2) Date: Sep. 12, 2018

(87) PCT Pub. No.: WO2017/158325
PCT Pub. Date: Sep. 21, 2017

(65) Prior Publication Data

US 2019/0080682 A1 Mar. 14, 2019

(30) Foreign Application Priority Data

Mar. 17, 2016 (GB) ..... 1604554.4

(51) Int. Cl.
*G10K 11/178* (2006.01)
*H04R 1/10* (2006.01)
(Continued)

(52) U.S. Cl.
CPC ..... *G10K 11/17881* (2018.01); *H04R 1/1083* (2013.01); *H04R 5/033* (2013.01);
(Continued)

(58) Field of Classification Search
CPC ..... G10K 11/17881; G10K 2210/1081; G10K 2210/3026; G10K 2210/3027;
(Continued)

(56) References Cited

U.S. PATENT DOCUMENTS 6,118,877 A * 9/2000 Lindemann ..... H04R 25/70 381/60
7,283,635 B1 * 10/2007 Anderson ..... H04M 1/60 381/384
(Continued)

FOREIGN PATENT DOCUMENTS

CN 202799151 U 3/2013
CN 103026247 A 4/2013
(Continued)

OTHER PUBLICATIONS

Temme, Headphone Testing, 2012.*
(Continued)

*Primary Examiner* — William A Jerez Lora
(74) *Attorney, Agent, or Firm* — Lempia Summerfield Katz LLC

(57) ABSTRACT

An earphone device/test station pairing (1, 2) includes an earphone device (1) including: at least one electroacoustic driver (32, 33, 34); a digital module (31) including a processor module; and a digital interface configured to connect the earphone device (1) to a media/communications device having a digital output; a test station (2) including at least one transducer (40, 42, 6), the test station (2) being operative to communicate with the earphone device (1) via the digital interface to allow data transmission between the earphone device (1) and the test station (2) during a test/configuration procedure; and a test module (4) for performing automated testing of the earphone device (1) when mounted on/connected to the test station (2).

29 Claims, 5 Drawing Sheets

(51) Int. Cl.
*H04R 5/033* (2006.01)
*H04R 29/00* (2006.01)

(52) U.S. Cl.
CPC ..... *H04R 29/00* (2013.01); *G10K 2210/1081* (2013.01); *G10K 2210/3026* (2013.01); *G10K 2210/3027* (2013.01); *G10K 2210/503* (2013.01); *G10K 2210/504* (2013.01); *H04R 2460/01* (2013.01)

(58) Field of Classification Search
CPC ..... G10K 2210/503; G10K 2210/504; H04R 1/1083; H04R 5/033; H04R 29/00; H04R 2460/01; H04R 5/00; H04R 25/552; H04R 25/30
USPC ..... 381/1, 23.1, 56, 58, 59, 60, 312
See application file for complete search history.

(56) References Cited

U.S. PATENT DOCUMENTS

2004/0196997 A1* 10/2004 Boonen ..... H04R 25/30 381/322
2007/0206825 A1* 9/2007 Thomasson ..... H04R 25/407 381/317
2008/0260171 A1* 10/2008 Nordahn ..... H04R 25/70 381/60
2011/0222696 A1* 9/2011 Balachandran ..... H04R 29/001 381/58
2011/0243343 A1* 10/2011 Gauger, Jr. ..... G10L 21/0208 381/71.6
2015/0036853 A1* 2/2015 Solum ..... H04R 25/558 381/315
2016/0212539 A1* 7/2016 Ikeda ..... G01H 11/08
2016/0286321 A1* 9/2016 Cole ..... H04R 25/30
2017/0055089 A1* 2/2017 Pedersen ..... H04R 25/554

FOREIGN PATENT DOCUMENTS

CN 103404168 A 11/2013
CN 103416075 A 11/2013
CN 203435147 U 2/2014
CN 204887138 U 12/2015
CN 204928958 U 12/2015
EP 1333701 A3 1/2004
WO 2011115836 A3 12/2011

OTHER PUBLICATIONS

International Search Report and Written Opinion in International Application No. PCT/GB2017/050645, dated Jul. 14, 2017, 13 pages.
Steve Temme et al., "Headphone Testing", Listen, Inc., Mar. 25, 2013, 10 pages.
Chinese Office Action 10252019, Chinese Office Action cited in the corresponding Chinese Application No. 201780017955.X; dated Oct. 25, 2019; 11 pp.

* cited by examiner

Enter Test Mode
S.U.T. : Acknowledge
Setup Test n
S.U.T. : Setup complete
Start Test n
(wait for data collection)
S.U.T. : Acknowledge
(wait for result computation)
End Test
Setup Test n+1
S.U.T. : Setup complete
Start Test n+1
(wait for data collection)
S.U.T. : Acknowledge
(wait for result computation)
End Test
Exit Test Mode
S.U.T. : Acknowledge

EARPHONE TEST SYSTEM

RELATED APPLICATION DATA

This U.S. national phase application is based on International Application No. PCT/GB2017/050645, filed on Mar. 10, 2017, which claimed priority to British Patent Application No. 1604554.4, filed on Mar. 17, 2016. Priority benefit of these earlier filed applications is hereby claimed.

The present invention relates to a system for enabling testing of an earphone device and particularly, but not exclusively to a system for enabling testing of an earphone device with Active Noise Reduction (ANR) functionality. Earphones (e.g. circumaural or supra-aural earphones of the type connected together by a headband to form headphones or in-ear/in-the-canal earphones configured to be placed at the entrance to or in the auditory canal of a user's ear) are well known in the art. Active earphone systems incorporating an active earphone driver for providing advanced active features such as Active Noise Reduction (ANR) or binaural monitoring are also well known in the art. ANR techniques offer the capability to cancel (at least some useful portion of) unwanted external sound and/or unwanted sound sensed by an internal sensing microphone via feedback control. The development and manufacture of active headphones and earphones and, particularly, those systems that incorporate active noise reduction, require accurate measurement of the electro-acoustic response of the component parts of the system in representative operating conditions. Such characterisation must be made on an individual sample-by-sample basis during manufacture as part of ordinary quality control procedures if there is any variability in either the performance of individual components used in the system or variability due to subtle unit-to-unit differences appearing in assembly. Such practical sample variance is inevitable.

Prior art active earphone devices, in which the greater part of both the internal electronics and electro-acoustics and the interface between the device and the system which provided source material, were implemented in analogue technologies, provided convenient means to interface at signal level between the device under test and a test system. New emerging systems rely more extensively upon digital technologies, both within the earphone device and in the interface between the earphone device and the device with which it is partnered. This digital realisation is complicating the provision of a test layer for development and manufacture. The complication arises due to i) the need to communicate configuration and control messages between the measurement system and the earphone device-under-test, ii) the need to gather and integrate data from across the spatially-extended and weakly connected test system and iii) difficulty in arranging time-synchronisation of the data, as required to compute coherent estimates of statistics across this test system.

The present applicant has identified the opportunity for an improved form of testing system that overcomes or at least alleviates limitations of the prior art and permits testing of earphone apparatus in a factory environment as part of the manufacturing process.

In accordance with a first aspect of the present invention, there is provided an earphone device/test station pairing comprising: an earphone device comprising: at least one electroacoustic driver; a processor module; and a digital interface configured to connect the earphone device to a media/communications device having a digital output; a test station comprising at least one transducer, the test station being operative to communicate with the earphone device via the digital interface to allow data transmission between the earphone device and the test station during a test/configuration procedure; and a test module for performing (e.g. rapid) automated testing of the earphone device when mounted on/connected to the test station.

In this way, an earphone device/test station pairing is provided that may be configured to provide enhanced testing/configuration of the earphone device (for example apparatus comprising ANR functionality) in a production line manufacture process using only the digital interface intended for receiving an audio input in normal use of the earphone device.

The earphone device may take the form of headphones (e.g. a pair of earphone units (typically circumaural or supra-aural earphone units) connected together by a headband) or headbandless in-ear/in-the-canal earphone units configured to be placed at the entrance to or in the auditory canal of a user's ear and held in place by engagement with the user's ears. Typically the earphone device is a multi-channel (e.g. stereo) device.

In one embodiment, the digital interface is a wired or wireless digital interface.

In one embodiment, the digital interface is configured to allow two-way digital communication between the earphone device and the test station.

In one embodiment, the test station communicates with the digital interface of the earphone device by means of a demountable interface sub-system. In this way the test station may be modified to allow operation with a number of different digital interface technologies.

In one embodiment, the processor module comprises an audio processing component.

In one embodiment, the earphone device comprises at least one microphone and the audio processing component is operative to process signals received from the at least one microphone.

In one embodiment, the at least one microphone and/or at least one electroacoustic driver are analogue devices and the audio processing component is operative to convert audio signals between digital and analogue forms.

In another embodiment, the at least one microphone and/or at least one electroacoustic driver are digital devices (i.e. the entire earphone device is potentially fully digital in design thereby obviating the need to convert audio signals between analogue and digital forms).

In one embodiment, the earphone device comprises at least one feedback microphone (e.g. for sensing pressure changes in a volume (e.g. sealed volume) between the driver of the earphone device and the auditory canal of a user's ear) and the audio processing component comprises a feedback Active Noise Reduction (ANR) function for processing signals received from the at least one feedback microphone.

In one embodiment, the earphone device comprises at least one feedforward microphone positioned to sense external ambient acoustic noise and the audio processing component comprises a monitoring function (e.g. feedforward ANR function or binaural monitoring/talk through function) configured to provide an audio signal based on sound measurements obtained from the at least one feedforward microphone.

In one embodiment, the processor module comprises a management component.

In one embodiment, the earphone device is programmable and the management component is configured to alter a configuration of the earphone device.

In one embodiment, the management component is configured to receive control data (e.g. from the test station) and alters a configuration of the earphone device in response to the received control data.

In one embodiment, the management component is operative to enter the earphone device in a test mode in response to receipt of a command (e.g. received from the test station via the digital interface).

In one embodiment, the processor module is operative in the test mode to perform at least one of: configure internal signal processing resources according to a specified test state; route specified signals (e.g. measurements recorded during testing) back to the test station via the digital interface; accept test patterns from the test station via the digital interface (e.g. intended for the electroacoustic driver of the headphone); route test patterns (e.g. intended for a driver of the test station) to the test station via the digital interface; recognise the start of a test phase; respond to the start of a test phase in a predefined time; acknowledge the end of the test phase by sending a response back to the test station via the digital interface.

In one embodiment, the at least one transducer of the test station comprises at least one test driver and/or at least one test microphone.

In one embodiment, the test module is operative to transmit audio signals to at least one driver of the earphone device/test station pairing and receive measurement signals from at least one microphone of the earphone device/test station pairing. Typically, the test module is configured to provide a multi-channel output and receive a multi-channel set of responses.

In one embodiment, the test module is configured to store one or more pre-generated test pattern operative to produce an input signal to drive the electroacoustic driver of the earphone device or a driver of the test station.

In one embodiment, the test module is configured to store and process received measurements.

In one embodiment, the test module further comprises a control interface for connecting the test module to a control device.

In a first group of embodiments, the test module is provided as part of the test station (e.g. with the test station transmitting command signals and/or audio signals to the earphone device via the digital interface and/or receiving measurements from the earphone device via the digital interface).

In a second group of embodiments, the test module is provided as part of the earphone apparatus (e.g. with the earphone apparatus transmitting audio signals to a test driver of the test station via the digital interface and/or receiving measurements from a test microphone of the test station via the digital interface). In this way, an advanced earphone device is provided capable of performing measurements on its own functions to allow self-calibration and tuning with the aid of access to the at least one transducer of the test station.

In one embodiment, at least one delay characteristic (e.g. time delay or group delay) of the earphone device is a predetermined parameter of the design of the earphone device and the predetermined parameter is used (e.g. by the test module) to apply correction to measurements recorded during testing of the earphone apparatus.

In one embodiment, the earphone device and test station are co-engineered whereby the test module is provided as part of the test station and is pre-programmed with the predetermined parameter of the at least one delay characteristic of the earphone device. In this way, the test station may apply the predetermined parameter of the at least one delay characteristic of the earphone device to the measurements recorded during testing of the earphone device.

In one embodiment, the time delay from the transmission of a command to start a test capture phase to the appearance of valid response data on the digital interface is a predetermined parameter of the design of the earphone device.

In one embodiment, the earphone device is configurable in a plurality of configured states and the group delay associated with each configured state (e.g. group delay associated with transducers, data converters or processing through any configured path) is a predetermined parameter of that configured state of the design of the earphone device.

In one embodiment, the test station comprises: a head simulator including an ear simulator part defining a passageway leading to an external opening; and an eardrum microphone mounted in the passageway of the ear simulator part.

In one embodiment, the eardrum microphone is mounted at an opposed end of the passageway to the external opening.

Typically the head simulator will be in the form of a head and torso simulator (HATS) device.

In one embodiment, the head simulator further comprises an internal test driver operative to generate a test signal. The internal driver may be mounted at an opposed end of the passageway to the external opening.

In one embodiment, the test station may comprise an external test microphone. For example, in the case of a test station comprising a head simulator the head simulator may further comprise at least one cheek-mounted microphone (e.g. left and right cheek-mounted microphones) for sensing externally generated sound. In one embodiment, the at least one cheek-mounted microphone comprises a sensor surface or a sensor inlet provided substantially in line with an outer surface of a cheek portion of the head simulator.

In one embodiment, the test station further comprises a mounting frame for at least one external test loudspeaker (e.g. left and right external test loudspeakers). The at least one external test loudspeaker may be configured to generate a predictable external noise field (e.g. predictable near-field noise field).

In one embodiment, at least one of the test station and the earphone device is operative to transmit audio signals to at least one driver (e.g. at least one electroacoustic driver of the earphone device or driver of the test apparatus—e.g. internal driver of the head simulator or external loudspeaker) and receive measurement signals from at least one microphone (e.g. microphone of the earphone device or microphone of the test apparatus—e.g. eardrum microphone or cheek-mounted microphone of the head simulator).

In one embodiment, the test module is operative to make estimates of electrical and/or electroacoustic transfer functions by comparing signals within the earphone device.

In one embodiment, the test station is operative to make estimates of electrical and/or electroacoustic transfer functions by comparing a first signal within the earphone device and a second signal external to the earphone device (e.g. measured by a test microphone of the test station).

In one embodiment, the test module is capable of computing configuration settings for the earphone device based on the estimated electrical and/or electroacoustic transfer functions.

In one embodiment, the test module is configured to compute configuration settings for the earphone device and uploading the computed configurations to the earphone device for the purpose of either i) performing further testing of the earphone device or ii) performing final programming of the earphone device.

In accordance with a second aspect of the present invention, there is provided an automated method of testing an earphone device during a production line manufacturing process comprising: providing an earphone device/test station pairing as defined in the first aspect of the invention (e.g. as defined in any embodiment of the first aspect of the invention); positioning the earphone device to be tested in a predetermined test position relative to the test station and running by means of the test module a program to perform the steps of: a test phase comprising: activating a pre-generated test pattern (e.g. using one or more driver of the test station or one or more driver of the earphone device); and collecting at least one response (e.g. using one or more microphone of the test station or one or more microphone of the earphone device); and an analysing step comprising analysing the at least one response.

In this way, an automated method of testing an earphone device with a digital interface is provided which is suitable for use in providing rapid testing in a production line manufacturing environment. Typically the method is implemented as a computer-implemented testing routine and will involve little user input after testing is initiated.

In one embodiment, the analysing step comprises one or more of: determining whether a determined property of the earphone device falls within an acceptable range; determining a value for calibrating or adjusting a programmable earphone device; performing diagnostic analysis; and collecting response data.

In one embodiment, the analysing step may comprise one or more of: a receiving response check; a receiver polarity check; a plant response check; a plant phase check; a plant fitting check; a gain adjust limit check; a feedback ANR check; an EQ response check; and a balance test.

For stereo earphone apparatus, typically both left and right channels of the earphone device will be tested. Accordingly, with the exception of the left/right audio balancing steps, each of the steps defined above may be carried out (e.g. simultaneously) for both the left and right channels.

Embodiments of the present invention will now be described by way of example with reference to the accompanying drawings in which.

The present invention advocates a new, mutualistic relationship between earphone devices and the test systems used to instrument them. The relationship is relevant when the earphone device has only a pure digital application interface between itself and the media or other data source with which the earphone device will be used in end application by the end user. This application interface will be exploited as the only link between the earphone device and the new measurement system, specially developed according to teachings presented herein, when it is the device-under-test during the testing and configuration phase of its manufacture. The present invention further teaches a new, complementary approach to programming such active earphone devices to include a 'test mode', enabling a deeper level of integration with the new measurement system than is possible with prior art approaches. This integration accommodates group delays, caused by transducers and digital processors in handling some signals, which are required during the observation of the electronic and electro-acoustic performance of the earphone device under test. This has particular relevance when the internal signals of the earphone device are processed in digital (quantized amplitude, time-discretised) form, as opposed to the analogue processing of earphone devices.

Figure 1:
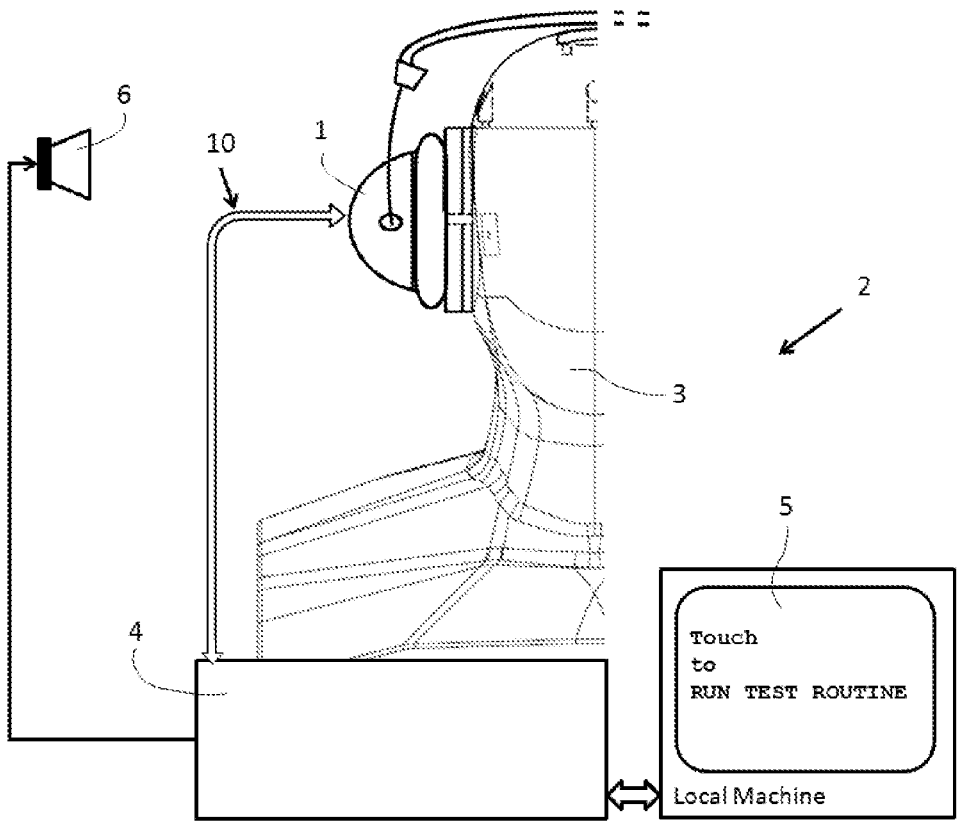
FIG. 1 is a schematic illustration of a headphone and test system pairing in accordance with an embodiment of the present invention.

FIG. 1 shows an earphone device 1/test system 2 pairing in accordance with an embodiment of the present invention.

Earphone device 1 is represented in FIG. 1 as one channel of a circumaural headphone system, but it is understood that the teachings of the present document apply not only to the other channel of a binaural test system, omitted from FIG. 1 for simplicity, but also to any other type of earphone device, including supra-aural headphones and any number of in-ear earphone devices intended to be worn in the concha or the auditory canal.

Test system 2 comprises a test stand 3 which incorporates some functions of a 'Head and Torso Simulator' (HATS) device, a test module 4 and a local machine 5 to facilitate user supervision and control (where appropriate) and interface to remote data storage and further processing. The system also has optional means to generate local sounds, by the provision of sound source(s) 6.

Headphones 1 mounted on the test system 2 are subjected to a test procedure, in which the entire test process is conducted by communication with the system-under-test through the digital application interface 10. This interface is that same interface that is provided for the end use of the headphone by the end user (e.g. connection to a media or communications device) and may (for example) be supported by a wired or wireless physical layer. The interface 10 is bi-directional, such that command-and-control information as well as signal data can pass in either direction (i.e. to or from system-under-test) along the interface.

Figure 2:
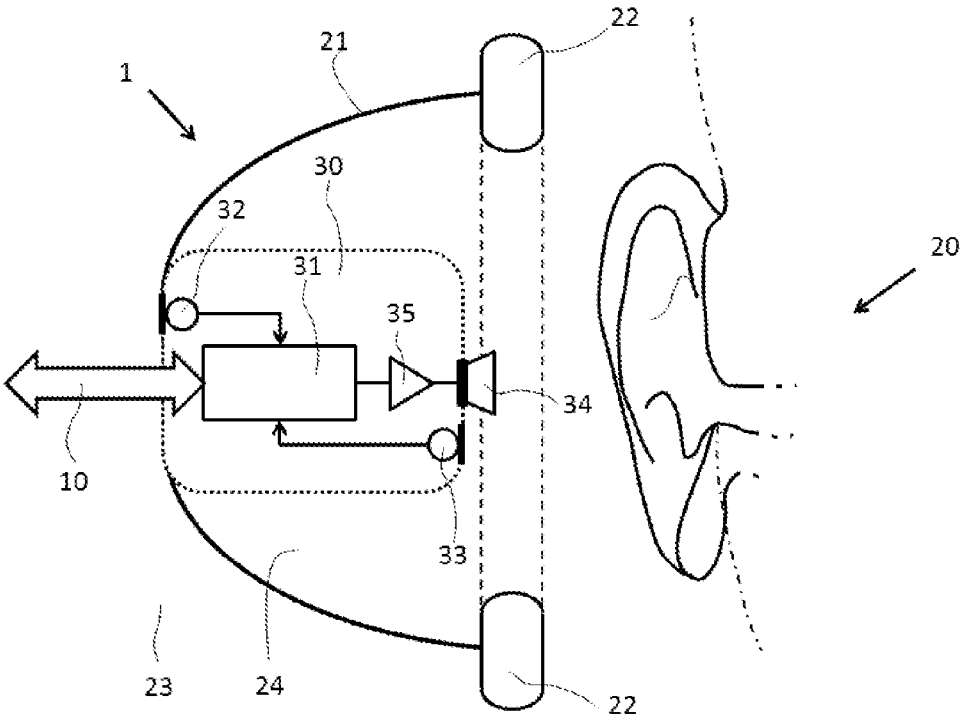
FIG. 2 is a detailed schematic view of the headphone of FIG. 1.

As illustrated in FIG. 2, headphone 1 is designed to mount on the ear 20 of the end user, some mechanical, geometrical and acoustical features of which shall be represented in the test system 2 by an artificial substitute. Headphone 1 comprises an outer body 21, which is sealed to the wearer's ear 20 (or its artificial analogue) by a cushion, pad or equivalent sealing component, 22. This forms two substantially isolated acoustic spaces; that outside the system-under-test (23) and that inside the system (24), including the wearer's ear.

The body 21 and the pad 22 allow headphone 1 to provide some degree of passive attenuation between ambient noise in the external space 23 and the noise which ingresses to the ear via the internal volume 24. This 'passive attenuation' is a useful property of the headphone, delivering utility to the end user. It will also define some of the operating environment of for the active elements of the system and is one of the parameters to be evaluated by the test system.

Headphone 1 further comprises active electronic elements 30 which communicate with external devices via the application interface 10. In light of this interface, which already has been stipulated to be realised in digital technology, the internal electronics 30 must be in part digital and include digital module 31. In fact, it will generally be assumed that all the internal electronics, 30 are realised using digital methods—but the teachings of this invention are agnostic to the technologies internal to the headphone. For the purposes of this description, everything inside the dotted line, labelled by integer 30, including the transducers, is assumed to accept digital electronic signals.

Headphone 1 includes at least one microphone 32 sensitive to the pressure in the external space 23 local to the body of the headphone, 21. The headphone further includes at least one microphone 33 sensitive to the pressure in the enclosed internal space 24.

Headphone further includes an electro-acoustic driver or 'receiver' 34 positioned so as to generate pressure in the internal space 24. Unlike microphones 32, 33, receiver 34 is required to deliver power and will be driven by a power stage 35. Receiver 34 and its power stage 35 may be realised in any appropriate technology.

Figure 3:
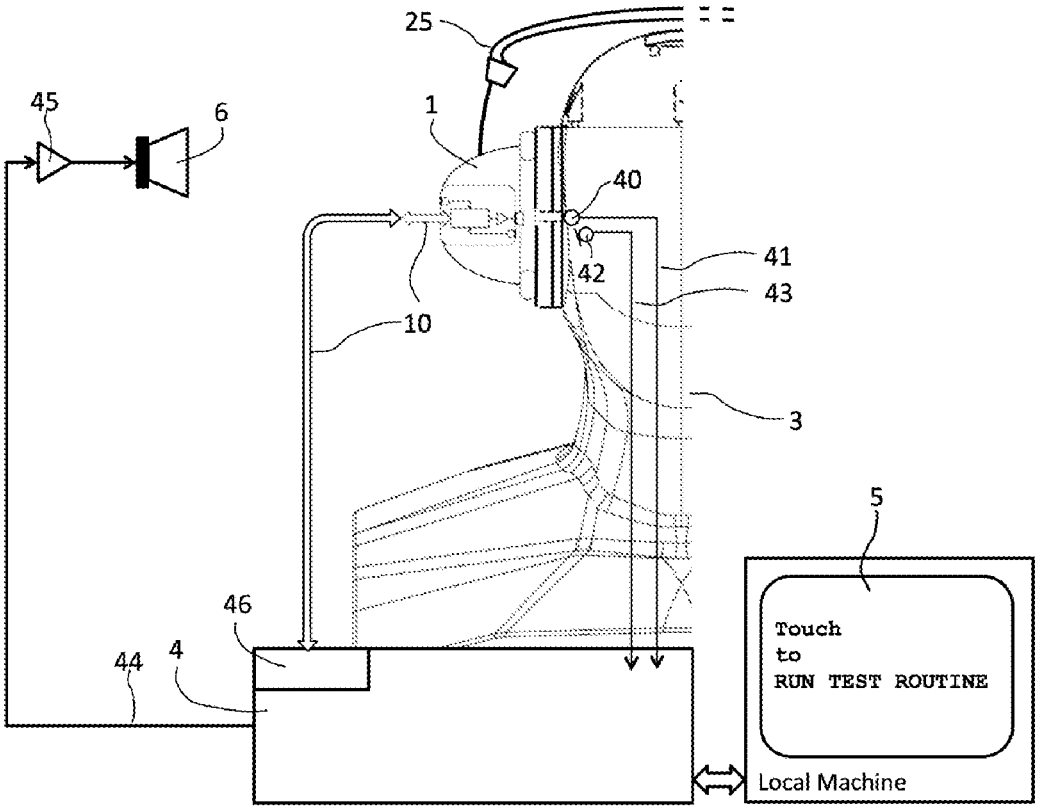
FIG. 3 is a more detailed schematic view of the headphone and test system pairing of FIG. 1.

During test, earphone 1 is mounted on test stand 3 as shown in FIG. 3. As illustrated, test stand 3 is adapted to hold headphone 1 using headband 25. In the case of earphone devices of differing form factor, other equivalent adaptations of the test stand allow for mounting or positioning.

When earphone 1 is correctly mounted on test stand 3, the provisions of the design of both the test stand 3 and of the headphone 1 are such that pad 22 is able to form an internal acoustic space 24 representative of that which would exist on an average human wearer of the device. This includes the provision of an artificial ear canal 52 in test stand 3.

The test stand 3 is provided with at least one internal microphone 40 sensitive to the pressure developed in the internal space 24 when the headphone 1 is correctly mounted. The output of the at least one internal microphone 40 is observed by the test module 4 of the test system 2 via the interface 41. The test stand 3 further comprises at least one external microphone 42 sensitive to the pressure which exists in the external space 23 proximate to the ear. In the case of a single microphone, an anterior location on the 'cheek' of the head of the test stand is preferred. The output of the at least one external microphone 42 is observed by the test module 4 of the test system 2 via the interface 43.

The test system 2 is able to generate output electrical signals to be used as stimuli and test patterns in acoustic measurements. These appear on the output 44, from where they are used to excite the local loudspeaker array 6. This array is driven by power amplifier(s) 45. Critically, the test module 4 of the test system 4 is able, via the sub-system 46, to connect via the application interface 10 to the headphone 1. This provides means by which the test system 2 can provide control inputs to the headphone 1 and can gather signal from the transducers (and other signal points) integral to the headphone 1, which constitute the observations important to measurement. In order that the system is capable of operating with a range of known digital application interface technologies (e.g. USB Audio or Bluetooth) and accommodate future interface standards, the sub-system 46 may be implemented as a 'plug-in' module. Application interface 10 may involve a wired, wireless or other physical layer.

Figure 4:
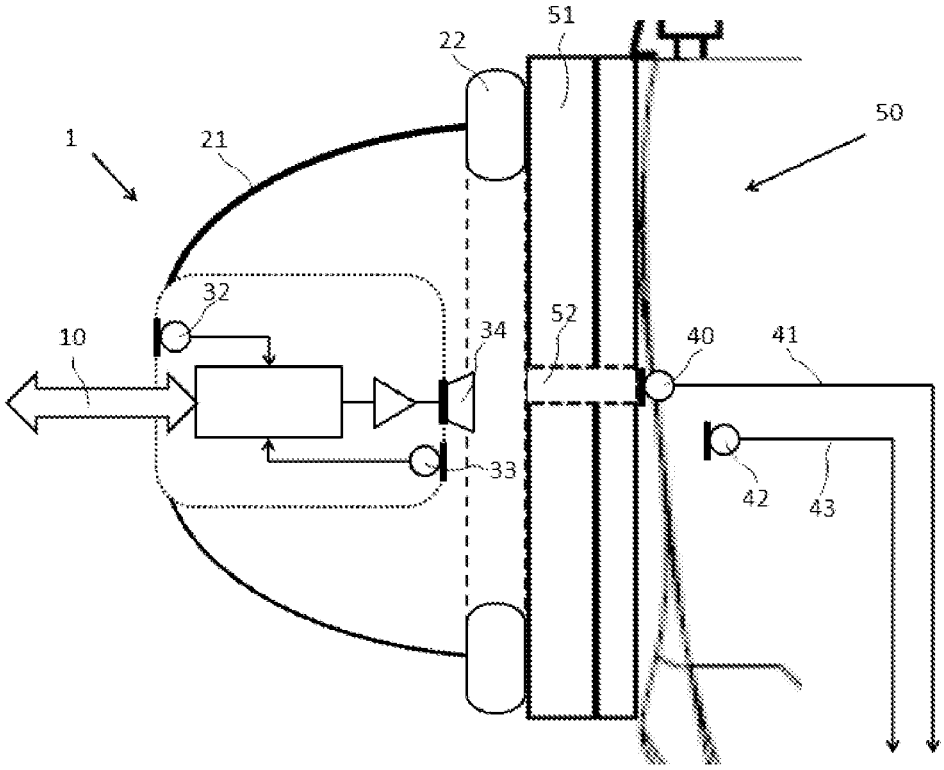
FIG. 4 is a detailed view illustration of the headphone of FIG. 1 when mounted on the test system.

FIG. 4 shows a detailed view of headphone 1 mounted on the artificial ear 50 of a test stand 3. The artificial ear 50 comprises a plate 51 for coupling to pad 22 of the headphone 1. The artificial ear canal 52 is located centrally in the plate 51 and forms a part of that enclosed interior volume of air 24 in communication with the air around microphone 33, receiver 34 and test stand microphone 40. In the low frequency limit, these points are all at the same pressure.

In practical use, with reference to FIG. 4, the system taught in the present document, makes measurement of transfer functions resulting from excitation of the system of FIG. 4 by either i) an input sequence delivered over the application interface 10 of ii) insonification by the external loudspeaker array 6 (of FIGS. 1 & 3) or iii) an input sequence stored or internally generated in the headphone 1.

The responses to this excitation from which the transfer functions are computed are formed of either i) the input sequences, ii) microphone responses (where the microphones are understood to be located either within the system-under-test [32, 33] or the test stand [40, 42]) or iii) signals at pre-defined positions within the system-under-test (where these signals will usually be numerical sequences but may, in the case of hybrid analogue-digital implementation, include analogue voltages).

When the response data includes elements collected on the headphone 1, such data must be passed back to the test module 4 over the application interface 10. Computation of all derived statistics of the system-under-test arising from the measurement presently is performed on the test module 4—although this does not preclude a future extrapolation of the teachings of this invention to the case of a more intelligent headphone, in which there is sufficient computational resource present on the headphone itself to require only access to the transducers of the test stand. Such an automatically-adjusting and configuring system is possible.

Figure 5:
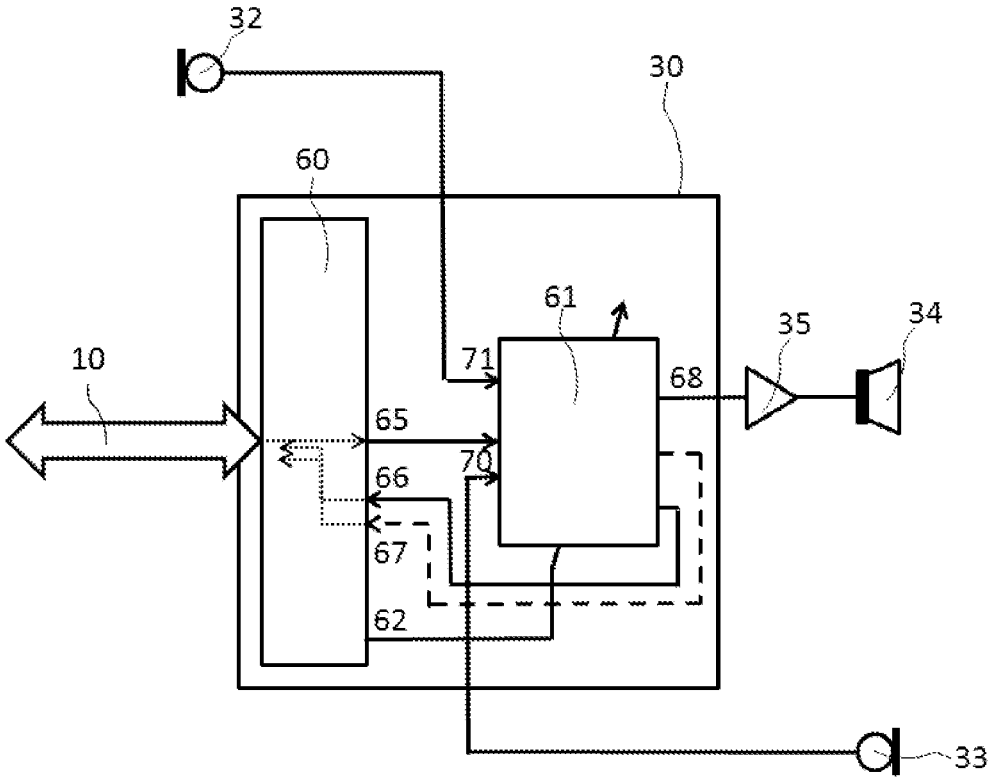
FIG. 5 is a detailed schematic view of the circuitry of the headphone of FIG. 1 in accordance with a first embodiment.

FIG. 5 shows the headphone electronics 30 in more detail. The application interface 10 is terminated in the headphone by interface circuitry (or the software equivalent thereof) 60 which performs several functions. On critical function is to decode incoming audio signals into the stream 65, which forms one input to the headphone's signal processing block 61.

The signal processing block performs a general functional mapping between inputs and (at least) two outputs: the output to drive the receiver 68 and an output capable of being passed back to the application interface to furnish (e.g.) uplink voice in telephony 66.

For the purpose of the present invention, the signal processing block has been generalised to admit a third output 67, which shall be made available during testing, in concert with 66, when it is required to pass a pair of returned response signals back from the system-under-test.

In addition to the input 65 already defined, the signal processing block accepts two further inputs: inputs 70 from the at least one microphone 33 sensitive to pressure in the enclosed inside space 24 and inputs 71 from the at least one microphone 32 sensitive to pressure in the outside space 23.

The signal processing block 61 is presented as a general three-input, three-output mapping between signals—no further definition or restriction is made or required except that:

- The system is assumed to be capable of being placed into known, stationary states at will on receipt over the application interface of appropriate commands
- The system is assumed to be capable of implementing these states and returning the appropriate responses back over the signals 66 & 67 with known (and predetermined) time delay This is achieved by the provision in the interface 60 (or otherwise in the headphone electronics) of means 62 to control and configure the signal processor block 61. This is achieved by the interpretation of configuration commands communicated to the system-under-test over the application interface, specific to the headphone design being tested. This is illustrated in the flowchart/pseudo-code extract of FIG. 6, in which the traffic over the application interface between test system and headphone under test is shown.

The test system 2 signals the intention to enter test mode, which is recognised and acknowledged by the headphone 1. Such acknowledgement is required to ensure the test system has the 'attention' of the system-under-test, which may not be programmed to offer a fast service time to other applications in ordinary use. Once the headphone 1 is in test mode, the test system 2 can request appropriate configuration for the first test. This constitutes setting up the signal processing block 61 in the correct state, defining the excitation pattern to be used and specifying the responses to be collected. Since the time to communicate or complete this configuration varies strongly between tests and between products, this phase is asynchronous, its end being defined by receipt of a 'Setup complete' message (or equivalent) from the headphone 1.

Once the headphone 1 is appropriately configured, the headphone 1 waits for a test to begin. The test is triggered by the test system 2 issuing a 'Test start' command and the headphone 1 will respond with known speed to the receipt of that command. The speed of this response (a fixed parameter of the hardware and/or software, known at time of development of the headphone) and the group delay associated with any data converters associated in the acquisition of responses specified in the particular measurement (again, known parameters of the design) will be accounted for once the data is post-processed. Once the test start is triggered, the headphone 1 processes the signals passed through its processing block 61, according to the configuration passed to it and returns any responses specified along signal paths 66 & 67.

Since the test is specified, the headphone 1 knows the test duration and will signal the end of the data acquisition phase with an acknowledgement, after which the test system 2 will compute the derived parameters which are to be estimated from the measurement. In making this estimation—which usually shall include calculations which otherwise would be disrupted by unknown time alignment between the system-under-test and the test system—the known response time and group delay parameters of the headphone are accounted for. This allows the computation of full, phase-synchronous statistics between signals within and without the headphone 1 on either side of the application interface 10.

Although the signal processing block 61 of FIG. 5 was presented as a general, abstract mapping between the three input signals 65, 70 & 71 and the three output signals 66, 67 & 68, this description already has spoken of the practical estimation of transfer functions. It is evident there is an expectation that many of the elements of 61 shall be linear, time—invariant filters. This is indeed true; many of the characterisations of the acoustics and electro-acoustics of the headphone systems currently obtained from these methods are cast as linear filters. There is, however, no reason why the teachings of the present invention should remain limited in this way.

Figures 6, 7:
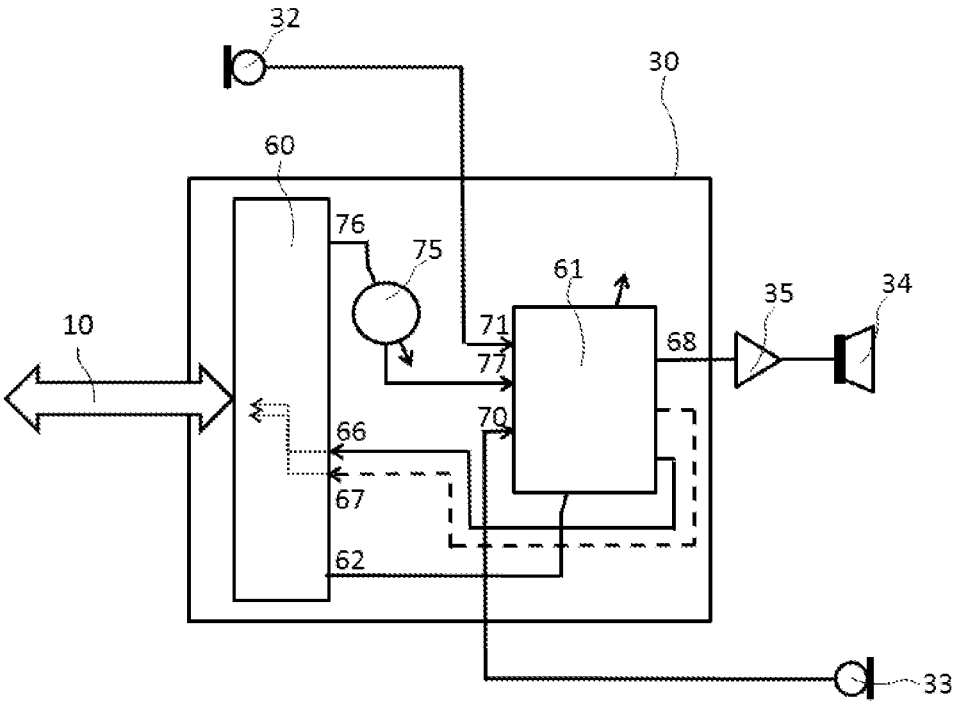
FIG. 6 illustrates typical communication between the test system and headphone of FIG. 1 during a testing procedure.
FIG. 7 is a detailed schematic view of the circuitry of the headphone of FIG. 1 in accordance with a second embodiment.

In certain situations, as depicted in FIG. 7, the headphone 1 may incorporate a signal generator 75 capable of generating a test pattern to be used as input in one of the tests. If this is both able to be generated with little computational load and is known (such that it can be reproduced on the test system), then the task of communicating the test pattern over the application interface is saved—an advantage in some circumstances.

The Maximum Length Sequence ('MLS') family of binary signals are a useful set of deterministic, broadband test signals, having embedded structure which makes time re-alignment feasible without the usual requirements for multi-channel, synchronous data acquisition.

The use of a MLS generator in 75 is a feasible extension of the present invention. In this case, a test pattern generator integral to the headphone required configuration (or, at least, control) 76 and produces an input 77 to the signal processing block, which replaces the usual downlink audio 65 from the application interface, as described earlier.

For the purpose of illustration, examples of the two most important classes of measurement that can be made on the system are now described. These are the categories in which an excitation is used to explore the transfer function between two variables where:

1) both the variables are signals existing within the headphone 1
2) one of the variables is a signal within the headphone 1 and the other is a signal external to the headphone 1.

Notice that the type 1) measurements are rather simpler, in that there is no explicit correction required to time align for the effects of the digital application interface 10 (there may be some time alignments required to understand group delays implicit in e.g. data converters within the headphone, but these will also be implicit in the design of the headphone and will be understood).

Figure 8:
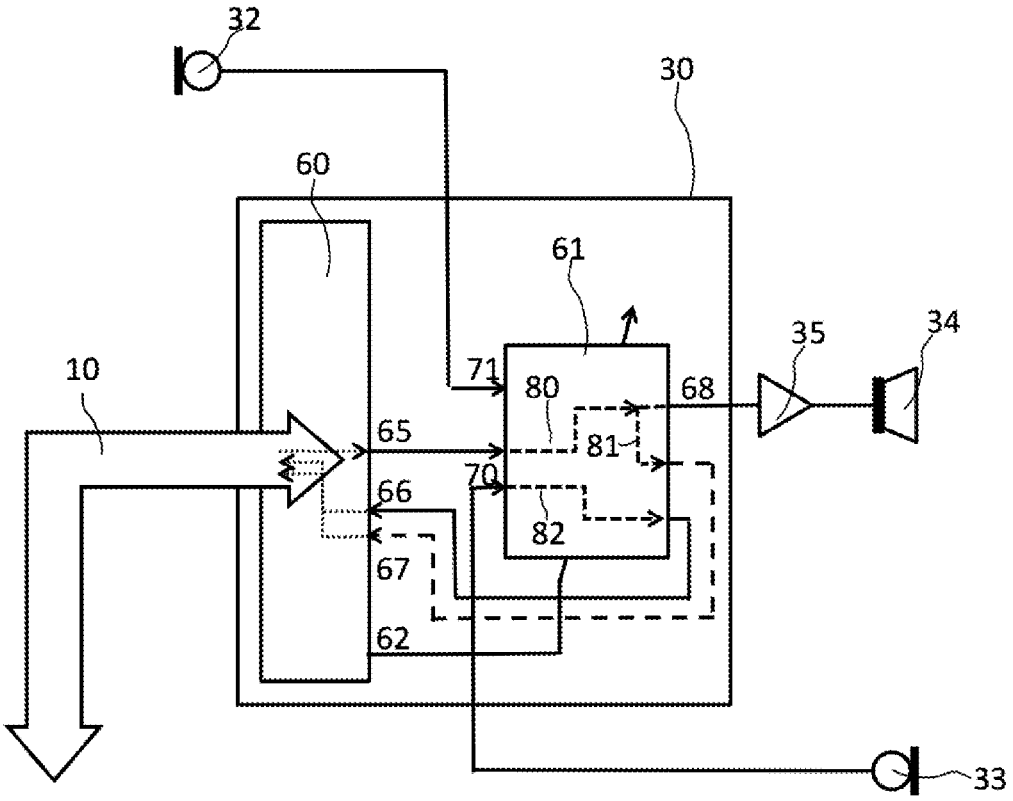
FIG. 8 is a detailed schematic view of the circuitry of the headphone of FIG. 1 during a first type of testing.

A type 1) measurement is exemplified in FIG. 8, which is typical of the configuration required to measure plant response for feedback control design (the ratio of feedback microphone voltage to receiver voltage) as excited by a test pattern generated by the test system 2.

In the test setup phase, the internal signal processing 61 is configured to provide the necessary signal routing. The test signal is applied via the signal path 65 and routed in the (temporary, test mode) signal processing configuration of the internal signal processing 61 through path 80 to drive the receiver 34. Note that if an amplifier 35 is present, its gain will be known (and, possibly, adjustable and also configured as part of the test set up) such that knowledge of the signal at 80, 68 amounts to knowledge of the receiver voltage. The receiver voltage is sensed at 81 and fed back to the measurement system over the application interface 10, via the signal path 67. This allows the processing path 80 to include filtering or other processing means (including e.g. control filters), which may eventually form part of the closed loop response of the system and which may themselves require validation, tuning and measurement. By this means, the test system 2 may make estimates of e.g. the magnitude response of the transfer function in path 80. The voltage from microphone 33, located in the enclosed space of the headphone and conventionally called the feedback microphone, is routed back to the measurement system over the digital application interface 10, via the signal path 66. The availability of the signals on paths 66 and 67 allow the (phase-synchronous) estimation of the transfer function between receiver voltage and the voltage on microphone 33.

Figure 9:
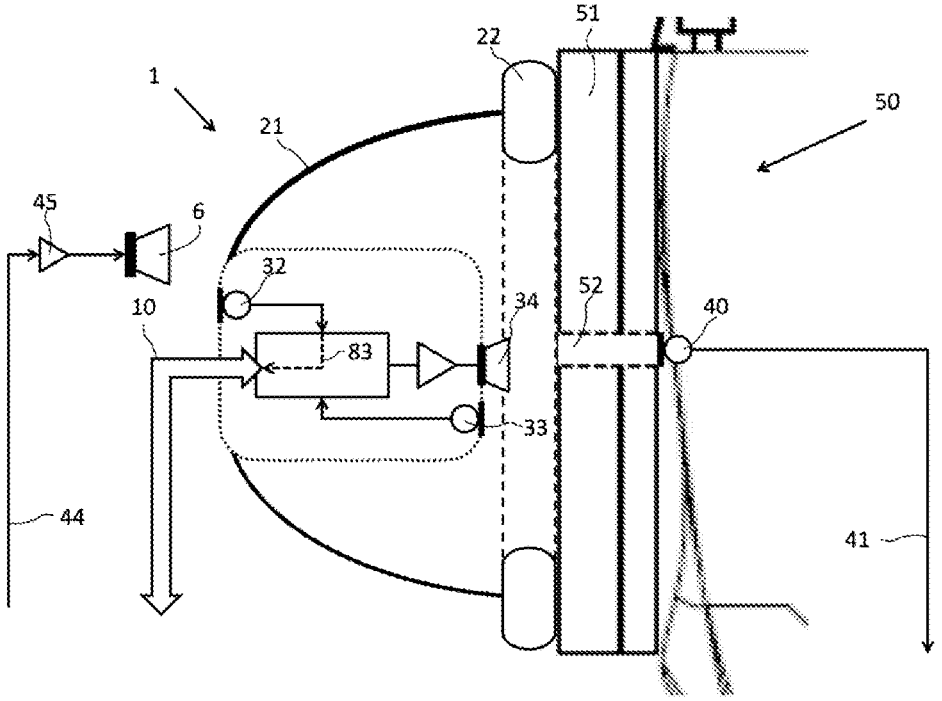
FIG. 9 is a detailed view illustration of the headphone of FIG. 1 when mounted on the test system during a second type of testing.

A type 2) measurement is exemplified in FIG. 9, which is typical of the configuration required to measure target response for feed-forward control design (the ratio of ear voltage to feedforward microphone voltage) as excited by a test pattern generated by the test system and presented acoustically by an external loudspeaker array 6.

In the test setup phase, the internal signal processing 61 is configured to provide the necessary signal routing. The test signal is applied via the signal path 44 and routed through amplifier 45 to drive the external loudspeaker 6 of test system 2. The voltage from microphone 32, located so as to be sensitive to sound outside the enclosed space of the headphone 1 and conventionally called the feedforward microphone, is sensed via the (temporary, test mode) signal processing configuration of the internal signal processing 61 through path 83 and fed back to the measurement system over the application interface 10. The voltage produces at the test stand's integrated ear microphone 40 is available through 41.

On test start, the signals from 83 and 41 are captured and the signal from 83 is time-aligned given the delay knowledge associated with the headphone 1, its configuration and the digital application interface 10. By this means, a phase-coherent estimate of the voltages at the feedback- and ear-microphones (and, thereby, the pressures at these positions) can be made as a target to inform feed-forward controller design.

The same system as has been described above (of a co-evolved personal audio system having digital application interface and a test system with which it can be used) is capable of repeating the test procedure to further refine a configuration in order (e.g.) to confirm predicted operation or to search iteratively for a closer match to a target tuning.

The core system described above, as used for testing, is able to exploit the 'programming' steps by which it configures the headphone 1 to program the device for end use. In this role it can function as a production tester and programmer, fulfilling all the test and configuration tasks required at the end of the production line.

The test system described above is generally assumed to know details of the delay mechanisms characteristic of the headphone under test. However, it is possible that the measurements made between signals entirely within the headphone 1 and between a first signal within the headphone 1 and a second signal in the test system 2 may be used to confirm the validity of these delay data. Such validity would be demonstrated by an appropriate structure in the cross correlation function between the two gathered signals after one signal had been corrected by the delay.

Further, it is possible in limited circumstances to use the test system 2 directly to establish the delay inherent in an unknown digital headphone. This is achieved, for example, by sending a test input to a headphone under test and gathering the resulting response from the test system 'ear' microphone. A time alignment, consistent with the observations made, provides a useful first approximation of group delay in the digital headphone and can be factorised to leave the electro-acoustic component of the measurement.

The invention claimed is:

1. Apparatus comprising an earphone device/test station pair, the earphone device/test station pair comprising:

an earphone device comprising:

at least one electroacoustic driver;

a processor module including an audio processing component; and a digital interface configured to connect the earphone device to a media/communications device having a digital output;

wherein the earphone device comprises at least one microphone, and the audio processing component is operative to process signals received from the at least one microphone;

a test station comprising at least one transducer, the test station being operative to communicate with the earphone device via the digital interface to allow data transmission between the earphone device and the test station during a test/configuration procedure; and a test module for performing automated testing of the earphone device when the earphone device is mounted on/connected to the test station;

wherein the processor module comprises a management component operative to enter the earphone device in a test mode in response to receipt of a command; and wherein the test module is operative to:

make estimates of electrical and/or electroacoustic transfer functions by:

comparing signals within the earphone device; and/or comparing a first signal within the earphone device and a second signal external to the earphone device; and compute configuration settings for the earphone device based on the estimated electrical and/or electroacoustic transfer functions.

2. Apparatus according to claim 1, wherein the at least one microphone and/or at least one electroacoustic driver are analogue devices and the audio processing component is operative to convert audio signals between digital and analogue forms.

3. Apparatus according to claim 1, wherein the at least one microphone and/or at least one electroacoustic driver are digital devices.

4. Apparatus according to claim 1, wherein the earphone device comprises at least one feedback microphone and the audio processing component comprises a feedback Active Noise Reduction (ANR) function for processing signals received from the at least one feedback microphone.

5. Apparatus according to claim 1, wherein the earphone device comprises at least one feedforward microphone positioned to sense external ambient acoustic noise and the audio processing component comprises a monitoring function configured to provide an audio signal based on sound measurements obtained from the at least one feedforward microphone.

6. Apparatus according to claim 1, wherein the earphone device is programmable and the management component is configured to alter a configuration of the earphone device.

7. Apparatus according to claim 1, wherein the processor module is operative in the test mode to perform at least one of:

configure internal signal processing resources according to a specified test state;

accept test patterns from the test station via the digital interface;

route specified signals back to the test station via the digital interface;

route test patterns to the test station via the digital interface;

recognise the start of a test phase;

respond to the start of a test phase in a predefined time; and/or acknowledge the end of the test phase by sending a response back to the test station via the digital interface.

8. Apparatus according to claim 1, wherein the at least one transducer of the test station comprises at least one test driver and/or at least one test microphone.

9. Apparatus according to claim 8, wherein the test module is operative to transmit audio signals to the at least one electroacoustic driver of the earphone device and/or to the at least one test driver of the test station pair and receive measurement signals from at least one microphone of the earphone device/test station pair.

10. Apparatus according to claim 8, wherein the test module is configured to store one or more pre-generated test pattern operative to produce an input signal to drive the electroacoustic driver of the earphone device or a driver of the test station.

11. Apparatus according to claim 1, wherein the test module is configured to store and process received measurements.

12. Apparatus according to claim 1, wherein the test module is provided as part of the test station.

13. Apparatus according to claim 1, wherein the test module is provided as part of the earphone device.

14. Apparatus according to claim 1, wherein at least one delay characteristic of the earphone device is a predetermined parameter of a design of the earphone device and the predetermined parameter is used to apply correction to measurements recorded during testing of the earphone device.

15. Apparatus according to claim 14, wherein the earphone device and test station are co-engineered whereby the test module is provided as part of the test station and is pre-programmed with the predetermined parameter of the at least one delay characteristic of the earphone device.

16. Apparatus according to claim 14, wherein a time delay from a transmission of a command to start a test capture phase to an appearance of valid response data on the digital interface is a predetermined parameter of a design of the earphone device.

17. Apparatus according to claim 14, wherein the earphone device is configurable in a plurality of configured states and a group delay associated with each configured state is a predetermined parameter of that configured state of a design of the earphone device.

18. Apparatus according to claim 1, wherein the test station comprises:

a head simulator including an ear simulator part defining a passageway leading to an external opening; and an eardrum microphone mounted in the passageway of the ear simulator part.

19. Apparatus according to claim 1, wherein the test module is configured to compute configuration settings for the earphone device and uploading the computed configurations to the earphone device for the purpose of either i) performing further testing of the earphone device or ii) performing final programming of the earphone device.

20. An automated method of testing an earphone device during a production line manufacturing process comprising:

providing an earphone device/test station pair as defined in claim 1;

positioning the earphone device to be tested in a predetermined test position relative to the test station and running by means of the test module a program to perform the steps of:

a test phase comprising:

activating a pre-generated test pattern; and collecting at least one response; and an analysing step comprising analysing the at least one response.

21. A method according to claim 20, wherein the analysing step comprises one or more of: determining whether a determined property of the earphone device falls within an acceptable range; determining a value for calibrating or adjusting a programmable earphone device; performing diagnostic analysis; and collecting response data.

22. A method according to claim 20, wherein the analysing step may comprise one or more of: a receiving response check; a receiver polarity check; a plant response check; a plant phase check; a plant fitting check; a gain adjust limit check; a feedback ANR check; an EQ response check; and a balance test.

23. Apparatus according to claim 14, wherein the predetermined parameter is used to apply correction to measurements recorded during testing of the earphone device to allow computation of full, phase-synchronous statistics between signals within and external to the earphone device on either side of the digital interface.

24. Apparatus comprising an earphone device/test station pair, the earphone device/test station pair comprising:

an earphone device comprising:

at least one electroacoustic driver;

a processor module including an audio processing component; and a digital interface configured to connect the earphone device to a media/communications device having a digital output;

wherein the earphone device comprises at least one microphone, and the audio processing component is operative to process signals received from the at least one microphone;

a test station comprising at least one transducer, the test station being operative to communicate with the earphone device via the digital interface to allow data transmission between the earphone device and the test station during a test/configuration procedure; and a test module for performing automated testing of the earphone device when the earphone device is mounted on/connected to the test station;

wherein the processor module comprises a management component operative to enter the earphone device in a test mode in response to receipt of a command; and wherein at least one delay characteristic of the earphone device is a predetermined parameter of a design of the earphone device and the predetermined parameter is used to apply correction to measurements recorded during testing of the earphone device.

25. Apparatus according to claim 24, wherein the earphone device and test station are co-engineered whereby the test module is provided as part of the test station and is pre-programmed with the predetermined parameter of the at least one delay characteristic of the earphone device.

26. Apparatus according to claim 24, wherein a time delay from a transmission of a command to start a test capture phase to an appearance of valid response data on the digital interface is a predetermined parameter of a design of the earphone device.

27. Apparatus according to claim 24, wherein the earphone device is configurable in a plurality of configured states and a group delay associated with each configured state is a predetermined parameter of that configured state of a design of the earphone device.

28. Apparatus according to claim 24, wherein the predetermined parameter is used to apply correction to measurements recorded during testing of the earphone device to allow computation of full, phase-synchronous statistics between signals within and external to the earphone device on either side of the digital interface.

29. An automated method of testing an earphone device during a production line manufacturing process comprising:

providing an earphone device/test station pair as defined in claim 24;

positioning the earphone device to be tested in a predetermined test position relative to the test station and running by means of the test module a program to perform the steps of:

a test phase comprising:

activating a pre-generated test pattern; and collecting at least one response; and an analysing step comprising analysing the at least one response.

* * * * *